United States Patent [19]

Banziger et al.

[11] 4,320,326

[45] Mar. 16, 1982

[54] ELECTRONIC DEVICE FOR CONTROLLING THE BRIGHTNESS OF AN ELECTRIC GAS DISCHARGE LAMP WITHOUT AN INCANDESCENT CATHODE

[75] Inventors: Walter Banziger, Wolfhalden; Hanspeter Coufal, Eggersriet, both of Switzerland

[73] Assignee: Elstrom Electronic AG, Wolfhalden, Switzerland

[21] Appl. No.: 189,923

[22] PCT Filed: Jan. 29, 1979

[86] PCT No.: PCT/CH79/00012

§ 371 Date: Oct. 11, 1979

§ 102(e) Date: Oct. 11, 1979

[87] PCT Pub. No.: WO79/00615

PCT Pub. Date: Sep. 6, 1979

[30] Foreign Application Priority Data

Feb. 11, 1978 [CH] Switzerland ..... 1488/78
Apr. 6, 1978 [CH] Switzerland ..... 3679/78

[51] Int. Cl.³ ..... H05B 41/392

[52] U.S. Cl. ..... 315/307; 315/199; 315/291; 315/308; 315/DIG. 4

[58] Field of Search ..... 315/194, 199, 291, 307, 315/308, 311, DIG. 4

[56] References Cited

U.S. PATENT DOCUMENTS 3,989,976 11/1976 Tabor ..... 315/291
3,991,344 11/1976 Tabor ..... 315/DIG. 4

*Primary Examiner*—Eugene R. LaRoche
*Attorney, Agent, or Firm*—Watson, Cole, Grindle & Watson

[57] ABSTRACT

For the purpose of controlling the electrical energy fed to an electrical gas-discharge lamp (20), without an incandescent cathode, as a function of a d.c. control voltage ($U_S$), there is a circuit arrangement (IC1, R3-R11, C4-C6, D-1), by means of which the ignition timing or angle of a triac (TR1) may be varied within each alternating-voltage half-wave. In order to prevent the lamp (20) from being completely extinguished unintentionally, when adjusted to minimal brightness, an additional circuit arrangement (30, 42, R12-R20, C7, D3, T1) is provided, ensuring a given minimal intensity of the current, flowing through said lamp (20), regardless of the level of said d.c. control voltage ($U_S$). Said additional circuit arrangement comprises a current transformer (30) and a rectifier arrangement (42) for producing a regulating voltage ($U_R$) dependent upon the intensity of the lamp current which controls an electronically variable resistance (T1). The latter influences the critical voltage for the ignition-angle-control whenever the intensity of the lamp current drops below a permissible minimal value, in such a manner that any further decrease in current intensity is automatically counteracted.

The device is intended, for example, for controlling the brightness of lighting units and of mercury-vapor lamps or high-pressure sodium-vapor lamps used for interiors, highways and tunnels.

13 Claims, 2 Drawing Figures

ELECTRONIC DEVICE FOR CONTROLLING THE BRIGHTNESS OF AN ELECTRIC GAS DISCHARGE LAMP WITHOUT AN INCANDESCENT CATHODE

The present invention relates to an electronic device for controlling the brightness of an electrical gas-discharge lamp, without an incandescent cathode, fed from an a.c. network, comprising a circuit arrangement for controlling the electrical energy, fed to the lamp, by varying the ignition angle within each alternating-voltage half-wave, as a function of an adjustable d.c. control voltage.

Many designs of electronic devices for controlling the brightness of incandescent filament lamps are known and in use. They operate on the basis of so-called phase-shift control in which the ignition angle, as measured beginning with the zero axis crossing of the current, is controlled within each alternating-voltage half-wave. Among known circuit arrangements for phase-shift control are those in which the ignition angle is variable as a function of an adjustable d.c. control voltage.

Whenever use is made of a circuit arrangement for phase-shift control, of the type described, for controlling the brightness of a gas-discharge lamp without an incandescent cathode, e.g. a mercury-vapour lamp or a sodium-vapour high-pressure lamp, it is found that when reducing the brightness that there is a danger of the lamp being completely extinguished, especially if voltage fluctuations, or brief voltage interruptions occur whenever the lamp is in the state of reduced brightness. Once the gas-discharge lamp has been extinguished, it cannot be ignited again, and thus switched on, until it has cooled down to ambient temperature.

Now it is the task of the present invention to create a relatively simple electronic device for controlling the brightness of an electrical gas-discharge lamp, with which device an unwanted extinction of the lamp is reliably avoided whenever its brightness is reduced.

According to the invention, this task is achieved by means of a device of the initially mentioned type, which has an additional circuit arrangement for producing a regulating voltage, dependent on the intensity of the current flowing through the gas-discharge lamp, for ensuring a given minimal intensity of the current flowing through the lamp automatically, regardless of the level of the d.c. control voltage.

The d.c. control voltage is preferably fed to a voltage divider consisting of a fixed resistor and a variable resistor controlled electronically by the regulating voltage, whereby a connecting point between said fixed and variable resistors is connected to an ignition-angle-control input of the first-mentioned circuit arrangement.

The device is a bipole and may therefore be simply arranged like a conventional on-off switch in one of the leads for the supply current to the gas-discharge lamp, and for this reason no additional installations are necessary.

The device comprising the above-mentioned characteristics of the invention is particularly suitable for controlling the brightness of a mercury-vapour lamp, thereby the brightness of the lamp may be reduced to about 3% of the brightness at full rated power, without any danger of inadvertently extinguishing the lamp completely.

It has been found that in case of controlling the brightness of a sodium-vapour high-pressure lamp, additional problems occur. The reason for this is to be found in the great difference between the characteristics of a mercury-vapour lamp and of a sodium-vapour high-pressure lamp. In the case of a sodium-vapour high-pressure lamp, the minimal admissible current intensity is largely dependent on the pertinent temperature of the lamp. At the normal operating temperature of the lamp, the minimal current intensity is relatively high, and decreases as the lamp temperature drops. In case the intensity of the lamp current is altered by varying the ignition angle by means of the d.c. control voltage, a change in the lamp temperature occurs only after a considerable delay in time, because of the thermal inertia of the lamp. Whenever the regulating voltage ensuring the minimal current is made dependent solely on the intensity of the current flowing through the lamp, and whenever it is dimensioned such that the lamp is not extinguished whenever, at normal operating temperature, i.e., at the full rated power of the lamp, the d.c. control voltage is adjusted to the minimal brightness value, then only a relatively slight reduction in brightness of the sodium-vapour high-pressure lamp results. With a progressive cabling down of the lamp, the minimal current intensity could be reduced, thus reducing the brightness of the lamp still further, with no danger of an undesirable total extinction of the lamp.

Thus, according to a further development of the present invention, the electronic device is to be of a configuration that the additional circuit arrangement also has arrangements for producing a component of the regulating voltage dependent upon the voltage appearing across the triac, for the automatic regulation of the minimal intensity of the current flowing through the lamp in adaptation to the characteristic of the lamp.

In a surprisingly simple and practical way, this design of the device according to the invention allows the regulating voltage, which serves to ensure a minimal current intensity in a sodium-vapour high-pressure lamp, to be made dependent not only on the intensity of the current flowing through the lamp, but also indirectly on the pertinent temperature of the lamp, since the alternating voltage across the triac always varies inversely to the voltage appearing across the lamp, and the latter voltage is dependent on the relevant lamp temperature. An additional conductor to determine the voltage across the lamp is not necessary; the device is still a dipole. This further development of the device of the invention makes possible the control of the brightness of a sodium-vapour high-pressure lamp over a wide range from full brightness at rated power, to less than 1% thereof, with no danger of undesirably extinguishing the lamp.

Further characteristics and details of desirable embodiments of the object of the invention will become apparent from the description given hereinafter, and from the relevant drawings in which the electrical wiring diagrams of preferred embodiments of the device of the invention for controlling the brightness of a gas-discharge lamp, are all illustrated purely by way of example. In the drawings.

Figure 1:
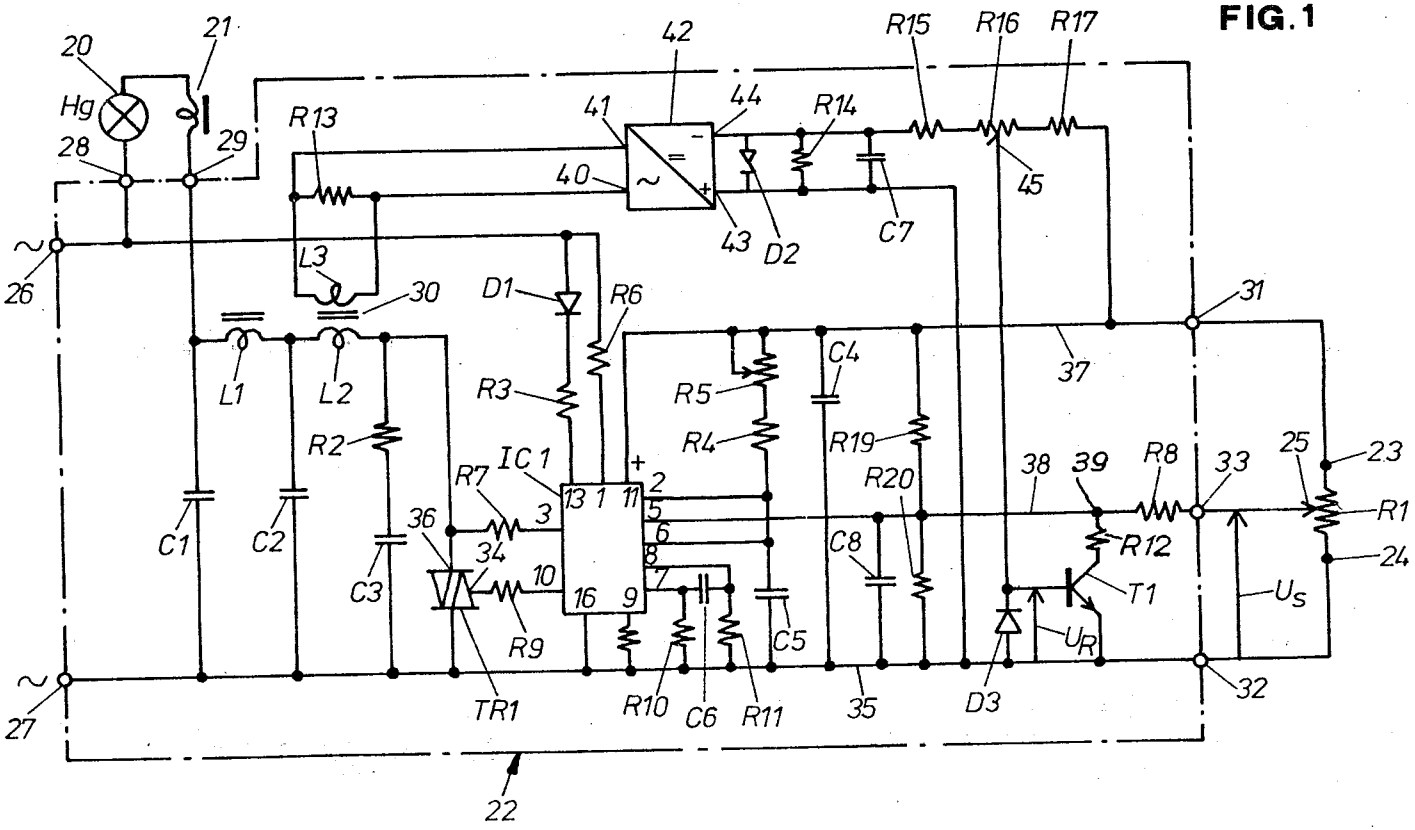
FIG. 1 shows, as a first example, the electrical wiring diagram for a device for controlling the brightness of a mercury-vapour lamp.

In FIG. 1, 20 indicates a mercury-vapour lamp, the brightness of which is to be controlled. Arranged in series with the mercury-vapour lamp in the usual manner is a choke 21 for the limitation of the current flowing through the lamp below a maximal value.

For controlling the brightness of the mercury-vapour lamp 20, use is made of an electronic device 22 and a potentiometer R1 with two terminal connections 23, 24 and an adjustable tap 25. By adjusting tap 25, the brightness of the lamp 20 may be controlled arbitrarily between a maximal and a minimal value, which amounts to only about 3% of the maximal value.

Electronic device 22 comprises two main terminals 26, 27 connecting the device to an alternating-current network of for example 220 V, two terminals 28, 29 for connecting to the mercury-vapour lamp 20, and choke 21, and three terminals 31, 32, 33 for connecting to control leads leading to connections 23, 24, 25 of potentiometer R1. The one mains terminal 26 and the one lamp terminal 28 are interconnected directly within device 22. Wired in series between the other mains terminal 27 and the second lamp terminal 29 are a triac TR1, a high-frequency locking choke L1, and the primary winding L2 of a current transformer 30. Capacitors C1, C2, and a series circuit of a capacitor C3 and a resistor R2, are provided to suppress high-frequency interference voltages.

Triac TR1 has a control electrode 34 to which an ignition pulse must be fed in each half-wave of the mains alternating voltage, in order to produce the flow of current. The following circuit arrangement, known per se, is provided to produce the ignition pulses: a commercial integrated circuit IC1, for example of the type TCA 280 A type by Philips, is connected, on the one hand, with its terminal 13, by way of a resistor R3 and a rectifier diode D1, to the mains terminal 26 and, on the other hand, with its terminal 16, directly to mains terminal 27, in order to obtain electrical energy from the a.c. mains. Also connected to terminal 16 is the ground lead 35 for the circuit arrangement. At a terminal 11, the integrated circuit IC1 makes available a constant direct voltage amounting f. ex., to +14 V in relation to ground lead 35. A capacitor C4, located between terminal 11 and ground lead 35, smoothes out said direct voltage. Located between terminal 11 and directly interconnected terminals 2 and 6, of the integrated circuit IC1, is a series circuit of a resistor R4 and a variable resistor R5, while a capacitor C5 is inserted between ground lead 35 and said terminals 2 and 6. This produces a saw-tooth voltage at terminals 2 and 6, the steepness of the leading slope of which may be varied, within certain limits, by means of variable resistor R5. Said saw-tooth voltage is synchronized with the half-waves of the mains alternating voltage by connecting a current path containing a resistor R6 between mains terminal 26 and a trigger-input 1 of the integrated circuit IC1. A blocking voltage terminal 3 of the integrated circuit IC1 is connected, through a resistor R7, to electrode 26, of triac TR1, facing away from ground lead 35, as a result of which the start of the rise of the saw-tooth voltage does not take place before the zero passage of the current in the mercury-vapour lamp supply circuit.

Control-lead terminal 31 is connected by means of a lead 37 to terminal 11, carrying the constant direct voltage, of integrated circuit IC1, whereas control-lead terminal 32 is connected to ground lead 35, so that a constant direct voltage of f. ex., 14 V is available at potentiometer R1. Control-lead terminal 33, connected to potentiometer tap 25, is connected through a resistor R8 and a lead 38, to an ignition-angle-control input 5 of the integrated circuit IC1. The level of the direct voltage at input 5 determines the ignition angle, or ignition moment, within each alternating-voltage half-wave. The ignition pulses appear at an output 10 of the integrated circuit IC1. Said output 10 is connected, through a resistor R9, to control electrode 34 of triac TR1. Each ignition pulse begins whenever the instant value of the saw-tooth voltage at terminal 6 agrees with the direct voltage at ignition-angle-control input 5. The duration of each ignition pulse is determined by a resistor-capacitor combination R10, R11, C6 which is connected to additional terminals 7, 8 and to ground lead 35.

The circuit arrangement described hitherto for controlling triac TR1 is known, and therefore there is no need to give a detailed explanation of the method of operation of it. In order to facilitate understanding, it is sufficient to mention that the level of d.c. control voltage $U_S$ between terminals 32, 33 depends on the position of potentiometer tap 25. Whenever this control voltage $U_S$ is equal to zero, i.e., whenever tap 25 is immediately adjacent to terminal 24, connected to ground lead 35, of the potentiometer R1, the ignition angle is zero. In this case, the ignition pulses at output 10 of integrated circuit IC1 start immediately after each zero passage of the mains alternating voltage, and therefore the mercury-vapour lamp 20 is supplied at full power and achieves its maximal brightness. Whenever tap 25 of potentiometer R1 is shifted farther and farther towards the other terminal 23 of the potentiometer, thereto control d.c. voltage $U_S$ between terminals 32, 33, increases, as a result of which the ignition angle is increased accordingly, and the ignition pulses experience an increasing delay toward the zero passages of the mains alternating voltage. Thus, current flows through triac TR1 and mercury vapour lamp 20 only during a part of each half-period of the alternating voltage, so that its brightness is reduced.

Whenever tap 25 of the potentiometer lies directly at terminal 23 of potentiometer R1, the ignition angle is at its maximum and the brightness of the mercury-vapour lamp 20 is at its minimum. In order to prevent, under these circumstances, any unintentional extinction of the mercury-vapour lamp, device 22 contains an additional circuit arrangement which automatically ensures that the intensity of the current flowing through the mercury-vapour lamp never drops below a specific minimal value. A description of this additional circuit arrangement, ensuring a minimal current, is given hereinafter.

Current transformer 30 has a secondary winding L3 which is loaded with a parallel resistor R 13 and is connected to input terminals 40, 41 of a rectifier arrangement 42. The rectifier arrangement 42 has a positive output terminal 43 connected to ground lead 35, and a negative output terminal 44. A Zener diode D2 to shunt away over-voltages in the event of a short-circuit in the supply circuit to mercury-vapour lamp 20, a load resistor R 14, and a capacitor C7 to smooth-out the rectified voltage are connected in parallel between output terminals 43, 44. The negative output terminal 44 of rectifier arrangement 42 is connected to lead 37—which has the constant d.c. voltage of f.ex., +14 V—through a voltage divider consisting of a resistor R 15, a potentiometer R 16, and a further resistor R 17. Potentiometer R 16 has an adjustable tap 45 from which is taken a regulating voltage $U_R$ dependent on the intensity of the current in the mercury-vapour lamp supply circuit. This regulating voltage $U_R$ is fed to the base of a n-p-n transistor T1, the emitter of which is connected to ground lead 35, and its collector is connected, through a resistor R12, to a lead 38 running to ignition-angle-control input 5 of integrated circuit IC1. The collector-emitter section of transistor T1 serves as a variable resistor, the resistance value of which is controlled electronically by regulating voltage $U_R$ lying at the base. Resistors R8 and R 12, as well as the collector-emitter section of transistor T1 serving as a resistor, together form a voltage divider to which the control d.c. voltage $U_S$, lying between terminals 32, 33 and adjustable by means of potentiometer R1, lies. The value of resistance of resistor R 12 is much less than that of resistor R8 and is almost negligible. The voltage fed through line 38, to the ignition-angle-control input 5 of the integrated circuit IC1 is tapped at junction 39 between resistor R8 and the series circuit of resistor R12 and of the transistor T1. Said voltage is dependent, on the one hand, on the position of tap 25 of potentiometer R1 and, on the other hand, on the relevant resistance value of the collector-emitter section of the transistor T1. A diode D3 is connected between the base and the emitter of the transistor T1, the polarity of the said diode being such that it prevents the appearance of voltages of negative polarity at the base of the transistor. Connected between reference-voltage lead 37 and control-voltage lead 38 is a resistor R19. Another resistor R20, and a charging capacitor C8 wired in parallel therewith, are located between ground lead 35 and control-voltage lead 38.

The method of operation of the additional circuit arrangement described, is as follows:

As long as regulating voltage $U_R$ at the base of transistor T1 is equal to zero, or is not positive in relation to ground lead 35 (it cannot become negative because of diode D3), the impedance of the collector-emitter section of transistor T1 is high, and for this reason said transistor T1 has no effect upon the control of brightness by means of d.c. control voltage $U_S$.

An alternating voltage is induced in secondary winding L 3 of current transformer 30, which is proportional to the intensity of the current flowing in the supply circuit of the mercury-vapour lamp 20. The induced alternating voltage is rectified in rectifier arrangement 42 and is smoothed-out by capacitor C7. Thus there is at capacitor C7 a direct voltage substantially proportional to the intensity of the lamp current, which is negative in relation to ground lead 35. This direct voltage is related, by means of the series circuit consisting of resistor R 15, potentiometer R 16 and resistor R 17, to the constant positive direct voltage at line 37. Tap 45 of the potentiometer R 16 is to be adjusted in such a manner that, in case of a given, relatively low intensity of the current flowing in the supply circuit of the mercury-vapour lamp 20, the effects of the negative voltage at output terminal 44 of the rectifier arrangement 42, on the one hand, and the positive reference voltage at line 37, on the other hand, on the potential at at tap 45, cancel each other out. At all higher intensities of the current flowing through lamp 20, especially whenever said lamp is operated at full power, the rectified voltage at output terminal 44 of rectifier arrangement 42 is more highly negative in relation to ground lead 35. As a result of this, the above described voltage equilibrium at tap 45 of potentiometer R 16 is disturbed in such a manner, that the potential at tap 45 would become negative in relation to ground lead 35, whenever this were not prevented by diode D3. There is therefore no positive control voltage $U_R$ at the base of transistor T1, and the brightness control of lamp 20 is determined solely by the d.c. control voltage $U_S$.

Whenever, by raising said control—d.c.—voltage $U_S$, the ignition angle is enlarged to an extent such that the intensity of the current in the supply circuit of lamp 20 threatens to drop below the above-mentioned minimal value, the negative potential at output terminal 44 of rectififer arrangement 42 drops so much, in relation to the ground lead, that a positive potential in relation to said ground lead develops at tap 45 of potentiometer R 16 and at the base of transistor T1. In this way the collector-emitter section of the transistor T1 is shifted to a conducting condition. As a result of this, voltage divider R8, R12, T1 comes into action, and the direct voltage at point 39 becomes lower in relation to ground lead 35 than control voltage $U_S$, adjusted at potentiometer R1. Since the voltage prevailing at point 39 is identical with that at ignition-angle-control input 5 of integrated circuit IC1, the ignition angle too, decreases accordingly, as a result of which the power supply to lamp 20 is increased, and this counteracts any further decline in the intensity of the current in the lamp supply circuit.

One can see that in the event of a decline in the intensity of the current flowing through lamp 20, below the value at which a voltage equilibrium prevails at tap 45 of potentiometer R 16, a counter-regulation takes place automatically, and thus a specific minimal current intensity is maintained automatically, even if an even lower current intensity would result on the basis of the control voltage $U_S$ set on the potentiometer R1, in which case there would be a danger of an unintentional complete extinction of the lamp. Thus, automatic regulation in dependence on the current intensity in the lamp supply circuit has priority over outside regulation by means of potentiometer R1. In practice, tap 45 of potentiometer R 16 is set, in adaptation to the individual properties of lamp 20 that is to be controlled, in such a manner that in case of an increase of control voltage $U_S$ to its maximal value, current-dependent regulating voltage $U_R$ assumes a value which is absolutely sufficient to prevent lamp 20 from being extinguished. However, in order that the brightness of mercury-vapour lamp 20 is reduced to a still tolerable value, the minimal current intensity in the lamp supply circuit must be selected as low as possible. Thus specific limits must be applied to the regulating range of the automatic, current-dependent ignition-angle control. This is achieved by means of resistors R 12, R 19 and R 20.

The automatic control, described to ensure a given minimal current intensity in the supply circuit of the mercury-vapour lamp 20, also comes into action, whenever the current intensity declines for reasons other than the setting of potentiometer R1 to below the admissible minimal value, for instance in case of fluctuation of the mains a.c. voltage or brief voltage collapses.

It should also be mentioned that changes in the brightness of mercury-vapour lamp 20 lag chronologically behind changes in the current, due to the thermal inertia of the lamp.

Capacitor C8 ensures that mercury-vapour lamp 20 may be cold-started without any difficulty, even if tap 25 of potentiometer R1 is set to minimal brightness of the lamp, i.e. is located directly at terminal 23 of said potentiometer. After terminals 26, 27 have been connected to the a.c. mains, capacitor C8 is indeed charged only gradually, for instance within 20 seconds, through resistor R 19. Since the voltage across capacitor C8 is initially equal to zero and thereafter increases only slowly, the ignition angle is also initially zero, regardless of the setting of tap 45 of potentiometer R1. Thus, during a few seconds after it has been switched on, mercury-vapour lamp 20 is fed at full current intensity so that the lamp quickly reaches its operating temperature, after which the current intensity gradually levels off at the value determined by d.c. control voltage $U_S$ or regulating voltage $U_R$.

Whenever the brightness of a plurality of mercury-vapour lamps is to be controlled, each of these lamps is assigned its own device 22. On the contrary, the control d.c. voltage $U_S$ may be produced for all of these devices 22 by means of a single potentiometer R1, terminal 24 and tap 25 of which are connected to control-line terminals 32, 33 of all devices 22. Instead of a potentiometer R1 for all devices 22, it is, of course, also possible to provide another source for producing and delivering the d.c. control voltage $U_S$.

Figure 2:
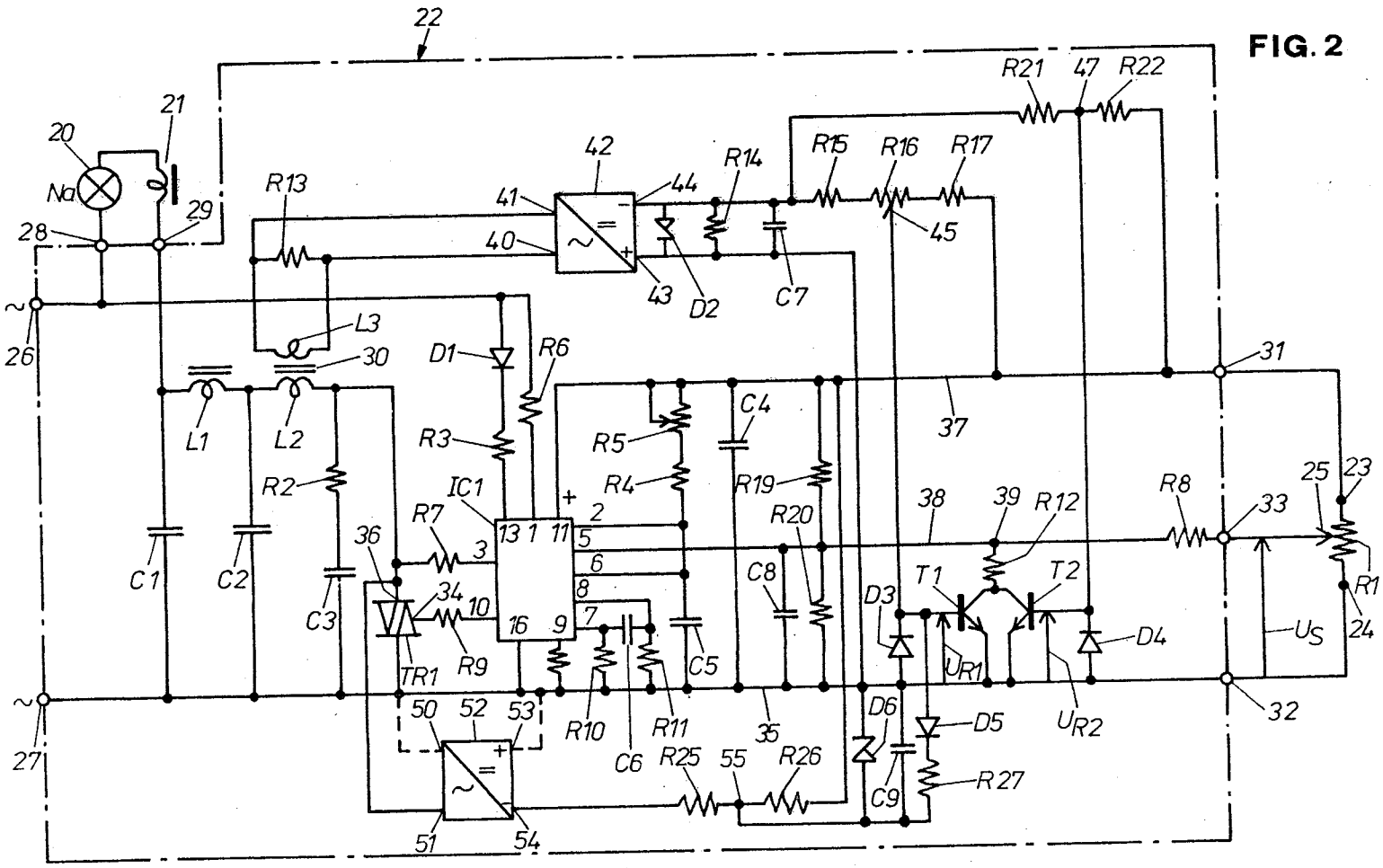
FIG. 2 shows, as a second example, the electrical wiring diagram of a device for controlling the brightness of a sodium-vapour high-pressure lamp.

The second embodiment of the invention serves to control the brightness of a sodium-vapour high-pressure lamp which is again marked 20 in FIG. 2, and to which a current-limiting choke 21 has been assigned again. Also visible again in FIG. 2 are an electronic device 22 and a potentiometer R1 with an adjustable tap 25 for the arbitrary change of the brightness of lamp 20. The difference as compared to the embodiment described in connection with FIG. 1 resides only in the electronic device 22. This contains exactly the same circuit arrangements, bearing the same reference numbers, as the design according to FIG. 1, but in addition to these it comprises the following circuit means and electronic components.

Arranged in parallel with voltage divider R 15, R 16, R 17 is another voltage divider consisting of two resistors R21, R22. Junction 47 between the resistors R21 and R22 is connected to the base of a second transistor T2, the collector-emitter section of which is connected in parallel with that of transistor T1. Located between the base and the emitter of this second transistor T2 is a diode D4, the polarity of which is such that it prevents the occurrence of voltages of negative polarity in the base of transistor T2.

Connected in parallel with triac TR1 in the supply circuit of the sodium-vapour high-pressure lamp 20, is the input 50, 51 of a second rectifier arrangement 52. The positive output terminal 53 of the rectifier arrangement 52 is connected to ground lead 35, and the negative output terminal 54 is connected to one end of a voltage divider consisting of two resistors R25 and R26. The other end of the voltage divider R25, R26 is connected to lead 37, carrying the constant direct voltage of f.ex., +14 V. Junction 55 between the two resistors R25 and R26 is connected, through a resistor R27 and a diode D5, to the base of transistor T1. Furthermore a smoothing capacitor C9 and a Zener diode D6 to carry away overvoltages are inserted between the junctions 55 and the ground lead 35. Whenever the rectifier arrangement 52 consists simply of a diode for one-way rectification, this eliminates input terminal 50, positive output terminal 53 and their connections to ground lead 35, in the wiring diagram shown, since then the said ground lead 35 itself constitutes the relevant connection.

The method of operation of the device according to FIG. 2 is basically the same as that of the device according to FIG. 1, as far as components common to the two circuits are concerned. For the sake of simplicity, therefore, the following explanations are limited to additional circuit arrangements and electrical components as compared to FIG. 1.

The regulating voltage $U_{R1}$, appearing at the base of transistor T1 has two components, namely a first component obtained by means of current transformer 30, rectifier arrange- 42, and voltage divider R15, R16, R17 in the manner already described, and it is dependent on the current flowing through the sodium-vapour high-pressure lamp 20, and the second component obtained by means of the second rectifier arrangement 52 and voltage divider R25, R26 and is dependent on the voltage appearing across triac TR1. The regulating voltage $U_{R2}$, appearing at the base of the second transistor T2 is obtained exclusively by means of current transformer 30, rectifier arrangement 42 and voltage divider R21, R22 and is therefore dependent solely on the intensity of the current flowing through the lamp 20.

Production and action of the first mentioned component of regulating voltage $U_{R1}$ are the same as described above with reference to the control voltage $U_R$. It should merely be mentioned here, that tap 45 of potentiometer R16 is to be adjusted such, that in case of a sudden increase in d.c. control voltage $U_S$ to its maximal value, the current-dependent component of the regulating voltage $U_{R1}$, assumes a value sufficient to prevent reliably extinction of the sodium-vapour high-pressure lamp 20, even if the lamp has reached its standard, full-power operating temperature.

The following applies to the production and operation of the second component of regulating voltage $U_{R1}$:

The alternating voltage appearing across triac TR1 prevails at the input 50, 51 of the second rectifier arrangement 52. This voltage is practically zero whenever full power is applied to lamp 20, i.e. when the ignition angle is zero. Whenever the ignition angle is increased, by increasing the d.c. control voltage $U_S$, adjustable by means of potentiometer R1, for the purpose of reducing the brightness of lamp 20, the alternating voltage across triac TR1 increases whereby at the same time, output terminal 54 of the rectifier arrangement 52 becomes negative in relation to ground lead 35. Then, the negative potential of output terminal 54 appears at one end of voltage divider R25, R26, and the positive potential of reference-voltage line 37 appears at the other end. The voltage at tap 55 of voltage divider R25, R26 lies anywhere between the two potentials mentioned and is smoothed out by capacitor C9. As long as the voltage at tap 45 is positive, as compared to the ground lead, it has no influence on the regulating voltage $U_{R1}$, since the diode D5 keeps positive voltages of tap 55 away from the base of transistor T1. Now the two resistors R25, R26 are dimensioned such that a voltage equilibrium prevails at tap 55, i.e., the voltage zero in relation to ground lead 35 prevails whenever the current in the lamp supply circuit of the sodium-vapour high-pressure lamp 20 is reduced to the previously explained minimal current intensity, which is necessary reliably to prevent said lamp 20 from being completely extinguished while said lamp is still at its standard, full-power operating temperature. This is always the case whenever, after the lamp has been operating at full power, i.e., at zero ignition angle, said ignition angle is increased by increasing the d.c. control voltage $U_S$ relatively quickly in order to reduce the brightness of the lamp to its minimal value.

After the current flowing through lamp 20 has been reduced to the previously described minimal intensity with the lamp at its standard operating temperature, said lamp gradually assumes a lower temperature, whereby the voltage appearing across the lamp 20 also drops in parallel to the temperature decrease, corresponding to the special burning characteristic of a sodium-vapour high-pressure lamp. The sum of the voltages across lamp 20, the choke coils L1 and 21, the primary winding L2 of current transformer 30, and triac TR1 is always equal to the mains voltage at terminals 26, 27. Since the minimal current intensity is kept practically constant with the aid of the component—dependent on the intensity of the current in the lamp supply circuit—of the regulating voltage $U_{R1}$, as previously explained, the voltage across choke coils L1 and 21, and across primary winding L2 of current transformer 30, remains practically constant. Consequently, whenever the voltage across lamp 20 drops, as the lamp cools down, the voltage across triac TR1 must increase to the same degree. At the same time, the potential at output terminal 54 of rectifier arrangement 52 becomes increasingly negative in relation to ground lead 35, and the voltage equilibrium at tap 55 of voltage divider R25, R26 is upset, in the sense that tap 55 becomes negative in relation to ground lead 35 and to be sure, the more strongly so, the more the sodium-vapour high-pressure lamp 20 in the manner described, a current flows from tap 45 of potentiometer R16, through diode D5 and resistor R27, to tap 55, as a result of which regulating voltage $U_{R1}$, which is positive in relation to ground lead 35, is reduced at the base of transistor T1. This produces a corresponding increase in the resistance value of the collector-emitter section of transistor T1, whereby the voltage at ignition-angle-control input 5 of the integrated circuit LC1 increases, and the ignition angle is also increased. The result is a further reduction in the power supplied to lamp 20, so that its brightness decreases still further.

It is clear that as the alternative voltage appearing across triac TR1 increases, as a result of the cooling of the sodium-vapour high-pressure lamp 20, fed at a reduced intensity of the current supplied, automatically regulation begins, which reduces the automatically assured minimal current intensity flowing through the lamp. This makes it possible to reduce the brightness of sodium-vapour high-pressure lamp 20 to a negligibly small residual brightness of less than 1% of the brightness at full power, without any danger of any undesirable complete extinction of the lamp. This decrease in brightness occurs at the same time gradually, corresponding to the progressive cooling of the lamp to a minimal temperature which appears eventually as a result of the reduced power supply. Since the regulating voltage $U_{R1}$ is dependent indirectly on the current in the lamp and, on the lamp voltage, the above described minimal-current-intensity control takes into account the actual power consumption of the sodium-vapour high-pressure of the lamp 20 operating at reduced brightness.

Second transistor T2 and regulating voltage $U_{R2}$, obtained through voltage divider R21, R22, ensure that the intensity of the current flowing through the lamp has a specific minimal value, whenever the lamp has been reduced by control to its minimal brightness in the manner described above. Resistors R21, R22 are dimensioned such that a voltage equilibrium prevails at tap 47, i.e. the potential is equal to zero in relation to ground lead 35, whenever the intensity of the current of the supply circuit of lamp 20 is still barely sufficient reliable to protect said lamp from being completely extinguished after its brightness has been reduced to its minimal value. The method of operation of transistor T2 is otherwise analogous to that of transistor T1, described in detail heretofore, as a function of the intensity of the current flowing through lamp 20.

In the second example of the embodiment, shown in FIG. 2, resistors R12, R19, and R20 produce an additional limitation of the ignition-angle adjusting range.

The automatic control described, which ensures a given minimal current intensity in the supply circuit of the sodium-vapour high-pressure lamp 20, also comes into effect whenever, for other reasons than the adjustment of the potentiometer R1, it might drop below the admissible minimal value, for example in case of fluctuations in the alternative mains voltage or of brief voltage dips.

As in the first example of the embodiment, capacitor C8 ensures that there is no problem in cold-starting the sodium-vapour high-pressure lamp 20, whenever the tap 25 of the potentiometer R1 is set to minimal lamp-brightness, i.e., whenever it is located directly near the potentiometer terminal 23.

Whenever the brightness of several sodium-vapour high-pressure lamps is to be controlled, each lamp is assigned its own device 22. D.c. control voltage $U_S$, on the contrary, may be produced for all these devices 22, by a single potentiometer R1, of which terminal 24 and tap 25 are connected to control-line terminals 32, 33 of all devices 22. Instead of potentiometer R1, common to all devices 22, another source for the production and delivery of d.c. control may of course also be provided.

The embodiments of the device of the invention described are suitable, for example, for controlling the brightness of mercury-vapour and sodium-vapour high-pressure lamps used to illuminate interiors, highways, and tunnels. One or the other of the embodiments described may also be used for controlling the brightness of other electrical gas-discharge lamps, according to their operating characteristics.

We claim:

1. An electronic device for controlling the brightness of an electrical gas-discharge lamp, having no incandescent cathode, from an alternating-current network, by means of a circuit arrangement for controlling the electrical energy fed to the lamp by a triac arranged in the lamp supply circuit, the ignition angle of the said triac being adjustable, within each alternating-voltage half-wave, as a function of a d.c. control voltage, an additional circuit arrangement being provided for the production of a regulating voltage dependent upon the intensity of the current flowing through the gas-discharge lamp, for the purpose of ensuring automatically a given minimal current intensity flowing through the said lamp, regardless of the value of the said d.c. control voltage, the said additional circuit arrangement comprising a rectifier arrangement and a current transformer, of which the primary winding lies in the supply circuit to the gas-discharge lamp, while the secondary winding thereof is connected to the input of the said rectifier arrangement, the said regulating voltage being derived from the output of the said rectifier arrangement, characterized in that the additional circuit arrangement (30, 42, R12–R17, C7, D3, T1; R21, R22, D4, T2) comprises a reference-voltage source (IC1, 35, 37)

and a voltage divider (R15, R16, R17), the ends of which are connected to the terminals (44, 37), of opposite polarity of the output of the rectifier arrangement (42), on the one hand, and of the reference-voltage source (IC1, 35, 37) on the other hand, whereas the other output terminals (43, 35) of the said rectifier arrangement (42) and the reference-voltage source, respectively, are connected together; and in that the regulating voltage ($U_R$; $U_{R1}$, $U_{R2}$) is taken from a tap (45; 47) of the said voltage divider (R15, R16, R17; R21, R22).

2. A device according to claim 1, characterized in that the d.c. control voltage ($U_S$) is fed to a further voltage divider (R8, T1) consisting of a fixed resistor (R8) and a variable resistor (T1) controlled electronically by the regulating voltage ($U_R$); and in that a junction (39) between the said fixed and variable resistors is connected to an ignition-angle-control input (5) of the first-mentioned circuit arrangement (IC1, R3–R11, C4–C6, D1).

3. A device according to claim 2, characterized in that the variable resistor is the emitter-collector section of a transistor (T1), to the base of which the regulating voltage ($U_R$) is applied.

4. A device according to claims 2 or 3, characterized in that a charging capacitor (C8) and a charging resistor (R19), associated therewith, are connected to the ignition-angle control input (5), so that whenever the gas-discharge lamp is switched on, the ignition-angle is initially zero and assumes the value determined by the d.c. control voltage ($U_S$) and the regulating voltage ($U_R$), only after a time-delay.

5. A device according to claim 1, particularly for controlling the brightness of a high-pressure sodium-vapour lamp, characterized in that the additional circuit arrangement also comprises devices (52, R25–R27, C9, D3, D5) for the purpose of producing a component of the regulating voltage ($U_{R1}$) dependent upon the voltage appearing across the triac (TR1), for the automatic regulation of the minimum intensity of the current flowing through the lamp (20), in adaptation to the characteristics thereof.

6. A device according to claim 5, characterized in that the additional circuit arrangement comprises a second rectifier arrangement (52), the input (50, 51) of which is in parallel with the triac (TR1) arranged in the lamp supply circuit; and in that a component of the regulating voltage ($U_{R1}$), dependent upon the intensity of the current flowing through the lamp (20), is derived from the output (43, 44) of the said first rectifier arrangement (42), while another component of the regulating voltage ($U_{R1}$), dependent upon the voltage appearing across the triac (TR1), is derived from the output (53, 54) of the said second rectifier arrangement (52).

7. A device according to claim 6, characterized in that the additional circuit arrangement also comprises a second voltage divider (R25, R26); in that output terminals (43, 53), of similar polarity, of the first and second rectifier arrangements (42, 52) are connected to each other and to the output terminal (35), of opposite polarity, of the said reference-voltage source (IC1, 35, 37); in that the other output terminals (44, 54) of the first and second rectifier arrangement (42, 52) are connected to one end respectively of the first and second voltage dividers (R15, R16, R17; R25, R26), the other ends of the two voltage dividers being connected to each other and to the second output terminal (37) of the said reference-voltage source; and in that each component of the regulating voltage ($U_{R1}$) is taken from a tap (45, 55) on the first and second voltage dividers (R15, R16, R17; R25, R26).

8. A device according to claim 6, characterized in that the d.c. control voltage ($U_S$) is fed to a third voltage divider (R8, T1) consisting of a fixed resistor (R8) and a variable resistor (T1) controlled electronically by the regulating voltage ($U_{R1}$), and in that a junction (39) between the fixed resistor (R8) and the variable resistor (T1) is connected to an ignition-angle-control input (5) of the first-mentioned circuit arrangement (IC1, R3–R11, C4–C6, D1).

9. A device according to claim 8, characterized in that the variable resistance is constituted by the collector-emitter section of a transistor (T1), to the base of which the two components of the regulating voltage ($U_{R1}$) are applied.

10. A device according to claim 8, characterized in that a second variable resistor (T2) is arranged in parallel with the variable resistor (T1), the said second variable resistor being controlled electronically by a second regulating voltage ($U_{R2}$) which is dependent solely upon the intensity of the current flowing through the lamp (20).

11. A device according to claim 10, characterized in that the second variable resistor is constituted by the collector-emitter section of a transistor (T2), to the base of which the second regulating voltage ($U_{R2}$) is applied.

12. A device according to claim 11, characterized in that a fourth voltage divider (R21, R22) is arranged in parallel with the first voltage divider (R15, R16, R17), the second regulating voltage ($U_{R2}$) being taken from a tap (47) on the said fourth voltage divider.

13. A device according to claims 8, 9, 10, 11 or 12, characterized in that a charging capacitor (C8) and a charging resistor (R19), associated therewith, are connected to the ignition-angle-control input (5), so that when the gas-discharge lamp (20) is switched on, the ignition angle is initially zero and assumes the value determined by the d.c. control voltage ($U_S$), and the regulating voltage ($U_{R1}$, $U_{R2}$), only after a time-delay.

* * * * *